US007481282B2

(12) United States Patent
Horst et al.

(10) Patent No.: US 7,481,282 B2
(45) Date of Patent: Jan. 27, 2009

(54) FLOW OPERATED ORIENTER

(75) Inventors: Clemens L. Horst, Houston, TX (US); David W. Teale, Spring, TX (US); Mark Heaton, Sherwood Park (CA)

(73) Assignee: Weatherford/Lamb, Inc., Houston, TX (US)

( * ) Notice: Subject to any disclaimer, the term of this patent is extended or adjusted under 35 U.S.C. 154(b) by 152 days.

(21) Appl. No.: 11/382,853

(22) Filed: May 11, 2006

(65) Prior Publication Data

US 2006/0254824 A1 Nov. 16, 2006

Related U.S. Application Data

(60) Provisional application No. 60/680,731, filed on May 13, 2005.

(51) Int. Cl.
*E21B 7/04* (2006.01)

(52) U.S. Cl. ..... 175/61; 175/74; 175/75

(58) Field of Classification Search ..... 175/57, 175/61, 74, 75

See application file for complete search history.

(56) References Cited

U.S. PATENT DOCUMENTS

| | | | | |
|---|---|---|---|---|
| 3,463,252 | A | | 8/1969 | Garrett et al. |
| 3,586,116 | A | | 6/1971 | Tiraspolsky et al. |
| 3,896,667 | A | | 7/1975 | Jeter |
| 3,908,759 | A | | 9/1975 | Cagle et al. |
| 4,187,918 | A | | 2/1980 | Clark |
| 4,462,469 | A | | 7/1984 | Brown |
| 4,678,045 | A | | 7/1987 | Lyons |
| 4,760,759 | A | | 8/1988 | Blake |
| 5,139,094 | A | * | 8/1992 | Prevedel et al. ..... 175/61 |
| 5,154,231 | A | | 10/1992 | Bailey et al. |
| 5,186,265 | A | | 2/1993 | Henson et al. |
| 5,215,151 | A | | 6/1993 | Smith et al. |

(Continued)

FOREIGN PATENT DOCUMENTS

EP 0 497 420 8/1992

(Continued)

OTHER PUBLICATIONS

GB Partial Search Report, Application No. GB0609390.9, dated Sep. 8, 2006.

(Continued)

*Primary Examiner*—Jennifer H Gay
*Assistant Examiner*—David Andrews
(74) *Attorney, Agent, or Firm*—Patterson & Sheridan, L.L.P.

(57) ABSTRACT

Some embodiments of the present invention generally provide an apparatus that may be used in a coiled tubing drillstring and that can switch between effectively straight drilling and curved drilling without halting drilling. Methods for steering a coiled tubing drillstring are also provided. In one embodiment, an apparatus for use in drilling a wellbore is provided. The apparatus includes a mud motor; a housing; an output shaft; and a clutch actuatable between two positions. The clutch is configured to rotationally couple the mud motor to the output shaft when the clutch is in a first position as a result of fluid being injected through the clutch at a first flow rate, and rotationally couple the output shaft to the housing when the clutch is in a second position as a result of fluid being injected through the clutch at a second flow rate.

21 Claims, 5 Drawing Sheets

U.S. PATENT DOCUMENTS 5,277,251 A 1/1994 Blount et al.
5,287,921 A 2/1994 Blount et al.
5,311,952 A 5/1994 Eddison et al.
5,311,953 A 5/1994 Walker
5,314,030 A 5/1994 Peterson et al.
5,316,094 A 5/1994 Pringle
5,332,048 A 7/1994 Underwood et al.
5,339,913 A 8/1994 Rives
5,363,929 A 11/1994 Williams et al.
5,368,110 A 11/1994 French
5,373,898 A 12/1994 Pringle
5,392,867 A 2/1995 du Chaffaut et al.
5,394,951 A 3/1995 Pringle et al.
5,431,219 A 7/1995 Leising et al.
5,441,119 A 8/1995 Head
5,443,129 A 8/1995 Bailey et al.
5,450,914 A 9/1995 Coram
5,483,987 A 1/1996 Amaudric du Chaffaut et al.
5,485,889 A 1/1996 Gray
5,488,989 A 2/1996 Leising et al.
5,503,235 A 4/1996 Falgout, Sr.
5,535,835 A * 7/1996 Walker ..... 175/73
5,538,091 A 7/1996 Theocharopoulos
5,547,031 A 8/1996 Warren et al.
5,617,926 A 4/1997 Eddison et al.
5,636,178 A 6/1997 Ritter
5,647,436 A 7/1997 Braddick
5,669,457 A 9/1997 Sebastian et al.
5,709,265 A 1/1998 Haugen et al.
5,725,060 A 3/1998 Blount et al.
5,735,357 A 4/1998 Palm
5,738,178 A 4/1998 Williams et al.
5,775,444 A 7/1998 Falgout, Sr.
5,787,978 A 8/1998 Carter et al.
5,826,651 A 10/1998 Lee et al.
5,831,177 A 11/1998 Waid et al.
5,836,406 A 11/1998 Schuh
5,887,655 A 3/1999 Haugen et al.
5,894,896 A 4/1999 Smith et al.
5,931,239 A 8/1999 Schuh
5,944,101 A 8/1999 Hearn
5,947,201 A 9/1999 Ross et al.
RE36,556 E 2/2000 Smith et al.
6,047,784 A 4/2000 Dorel
6,059,050 A 5/2000 Gray
6,082,453 A 7/2000 Bakke
6,082,457 A 7/2000 Best et al.
6,116,354 A 9/2000 Buytaert
6,129,160 A 10/2000 Williams et al.
6,158,529 A 12/2000 Dorel
6,158,533 A 12/2000 Gillis et al.
6,176,327 B1 * 1/2001 Hearn ..... 175/61
6,216,802 B1 4/2001 Sawyer
6,244,361 B1 6/2001 Comeau et al.
6,296,066 B1 10/2001 Terry et al.
6,315,062 B1 11/2001 Alft et al.
6,415,878 B1 7/2002 Cargill et al.
6,419,014 B1 7/2002 Meek et al.
6,439,321 B1 8/2002 Gillis et al.
6,446,737 B1 9/2002 Fontana et al.
6,454,007 B1 * 9/2002 Bailey ..... 166/298
6,554,083 B1 4/2003 Kerstetter
6,561,289 B2 5/2003 Portman et al.
6,571,888 B2 * 6/2003 Comeau et al. ..... 175/61
6,598,687 B2 7/2003 Eppink et al.
6,607,043 B1 8/2003 Sunde et al.
6,607,044 B1 8/2003 Eppink et al.
6,609,579 B2 8/2003 Krueger et al.
6,626,254 B1 9/2003 Krueger et al.
6,659,201 B2 12/2003 Head et al.
6,659,203 B1 12/2003 Cruickshank et al.
6,769,499 B2 8/2004 Cargill et al.
6,945,328 B2 9/2005 Cruickshank et al.
6,955,231 B1 10/2005 Bakke
7,028,789 B2 4/2006 Krueger et al.
7,234,544 B2 6/2007 Kent
7,306,060 B2 12/2007 Krueger et al.
7,347,282 B2 3/2008 Betts et al.
2001/0022241 A1 9/2001 Portman et al.
2001/0052427 A1 12/2001 Eppink et al.
2002/0162659 A1 11/2002 Davis et al.
2002/0166701 A1 11/2002 Comeau et al.
2004/0089478 A1 5/2004 Cruickshank et al.
2004/0089480 A1 5/2004 Dewey
2005/0023037 A1 * 2/2005 Camp ..... 175/61
2006/0254824 A1 * 11/2006 Horst et al. ..... 175/61
2007/0107937 A1 * 5/2007 Sugiura ..... 175/45
2007/0235227 A1 10/2007 Kirkhope et al.
2007/0256865 A1 11/2007 Cruickshank

FOREIGN PATENT DOCUMENTS

EP 0 685 628 12/1995
EP 0 770 759 5/1997
EP 0 774 563 5/1997
EP 1 291 486 3/2003
GB 227195 1/1995
GB 2 326 898 1/1999
WO WO 93/10326 5/1993
WO WO 96/19635 6/1996
WO WO 97/16622 5/1997
WO WO 98/38410 9/1998
WO WO 01/00960 * 1/2001

OTHER PUBLICATIONS

Greener, "Transatlantic Synergy Helps Drill Better Horizontal Holes," Hart's Petroleum Engineer International, Aug. 1998, pp. 37, 40, vol. 71.
"Economic Advantages of a New Straight-Hole Drilling Device," Journal of Petroleum Technology, Dec. 1999, pp. 26, 35, vol. 51.
Elsborg et al., "High Penetration Rate Drilling with Coiled Tubing," SPE 37074, presented at the 1996 SPE International Conference on Horizontal Well Technology in Calgary, Canada, on Nov. 18-20, 1996, pp. 333-343.
http://www.rotarysteerable.com/product.htm print date: Feb. 20, 2001.
http://www.halliburton.com/sperry-sun/services/drill/extend.asp print date: Feb. 20, 2001.
"Advanced BHAs Extend Capability, Boost Efficiency," Drilling Contractor, Jan./Feb. 2001, pp. 28-30.
"Drilling Equipment: Improvements from Data Recording to Slim Hole," Drilling Contractor, Mar./Apr. 2000, pp. 30-32.
Derkach, "High-Torque Gear Reducer Expands Turbodrill Capabilities," Oil and Gas Journal, Jul. 5, 1999 (at http://www.findarticles.com/cf_0/m3112/27_97/55221538/rint.jhtml print date: Feb. 28, 2001).
"Directional Drilling: Improving Efficiency and Control," Drilling Contractor, Mar./Apr. 2000, pp. 44, 46.
Ridgen et al., "New Tool That Will Improve Coiled Tubing Directional Drilling," World Oil's 4th International Conference and Exhibition, Houston, Texas, Mar. 1996, pp. 1-6.
Leising et al., Extending the Reach of Coiled Tubing Drilling (Thrusters, Equalizer and Tractors), SPE 37656, SPE/IADC Drilling Conference, Mar. 4-6, 1997, pp. 1-14.
Sperry-Sun Drilling Services, "Predictable Torque and Bit Speed Delivered Directly to the Bit," 1991, 1998.

* cited by examiner

FLOW OPERATED ORIENTER

CROSS-REFERENCE TO RELATED APPLICATIONS

This application claims benefit of U.S. Provisional Patent Application No. 60/680,731, filed May 13, 2005, which is hereby incorporated by reference in its entirety.

BACKGROUND OF THE INVENTION

1. Field of the Invention

Embodiments of the present invention generally relate to directional drilling in a wellbore.

2. Description of the Related Art

Conventional directional drilling with jointed pipe is accomplished through use of a Bottom Hole Assembly (BHA) consisting of a bent housing directional drilling motor and directional Measurement While Drilling (MWD) tool in the following fashion.

To drill a curved wellbore section, the drillstring is held rotationally fixed at the surface and the drilling motor will drill a curved wellbore in the direction of the bend in its outer housing. This is termed "slide" drilling because the entire drillstring slides along the wellbore as drilling progresses. The wellbore trajectory is controlled by orienting the BHA in the desired direction by rotating the drillstring the appropriate amount at the surface.

To drill a straight wellbore section, the drillstring is rotated at the surface with the rotary table or top-drive mechanism at some nominal rate, typically 60 to 90 rpm. This is termed "rotating" drilling. In so doing, the tendency of the bent housing motor to drill in a particular direction is overridden by the superimposed drillstring rotation causing the drilling assembly to effectively drill straight ahead.

When drilling with coiled tubing neither "rotating" drilling nor rotational orientation of the BHA can be accomplished without the addition to the BHA of a special rotating device to orient the BHA since coiled tubing cannot be rotated at the surface in the wellbore. One such rotational device, or orienter, operates by rotating in even angular increments, for example 30°, each time the surface pumps are stopped and then re-started. After each pump cycle, the orienter locks into and maintains its rotational position. This "ratcheting" device allows the directional driller to position the directional assembly closely enough to the desired toolface orientation to allow the wellbore to be drilled in a particular direction.

One significant drawback to directional drilling with the ratcheting orienter described above is the fact that drilling must be stopped each time the orienter is actuated. For example, if a rotational change of 210° is needed, drilling is stopped, the BHA is lifted off-bottom, and the pumps must be cycled 7 times to rotate the BHA by the required amount. This non-productive time is significant and has an adverse affect on the average drilling rate. In the case in many Canadian wells, an entire well is drilled in a matter of 6 to 8 hours. The time spent orienting can become a significant portion of the total drilling time.

A second drawback to directional drilling with the ratcheting orienter relates to its inability to drill an effective straight wellbore section. As described above, in conventional directional drilling, continuous drillstring rotation is used to wash-out the directional tendency of a bent-housing motor. This produces a very straight trajectory. When drilling with coiled tubing and a ratcheting orienter, continuous rotation is not possible. Thus the driller is forced to orient slightly left of the desired path and drill some distance ahead. Then after stopping to re-orient right of the desired path, the driller drills ahead again. This process is repeated until the "straight" section is completed. The resulting left-right-left or "wig-wag" wellbore trajectory roughly approximates the desired straight path.

Therefore, there exists a need in the art for an orienter that may be used in a coiled tubing drillstring and that can switch between effectively straight drilling and curved drilling without halting drilling.

SUMMARY OF THE INVENTION

Some embodiments of the present invention generally provide an apparatus that may be used in a coiled tubing drillstring and that can switch between effectively straight drilling and curved drilling without halting drilling. Methods for steering a coiled tubing drillstring are also provided.

In one embodiment, an apparatus for use in drilling a wellbore is provided. The apparatus includes a mud motor; a housing; an output shaft; and a clutch. The clutch is operable to rotationally couple the output shaft to the housing when the clutch is in a first position, rotationally couple the motor to the output shaft when the clutch is in a second position, and actuate from one of the positions to the other of the positions as a result of fluid being injected through the clutch at a flow rate which is greater than or equal to a predetermined threshold flow rate.

In another embodiment, an apparatus for use in drilling a wellbore is provided. The apparatus includes a housing having a splined portion for mating with a second splined portion of a locking sleeve; an input shaft having a splined portion for mating with a first splined portion of the locking sleeve; the locking sleeve having a flow bore therethrough, and a third splined portion rotationally coupling the locking sleeve to a splined portion of an output shaft. The locking sleeve is actuatable between a first axial position and a second axial position by choking of fluid through the flow bore. The locking sleeve mates with the splined portion of the housing in the first axial position and the splined portion of the input shaft in the second axial position. The apparatus further includes the output shaft; and a spring disposed between the output shaft and the locking sleeve, the spring biasing the locking sleeve towards one of the axial positions.

In another embodiment, a method for drilling a wellbore is provided. The method includes drilling in a first direction while injecting fluid through a drilistring at a first flow rate; and changing the flow rate to a second flow rate, wherein an orienter changes the direction of drilling to a second direction, and drilling remains continuous while changing the flow rate. In one aspect, the first direction is a substantially straight direction and the second direction is a curved direction. In another aspect, the first direction is a curved direction and the second direction is a substantially straight direction.

In another embodiment, a method for drilling a wellbore is provided. The method includes providing a drillstring. The drillstring includes a run-in string and an orienter. The orienter includes a motor; a housing coupled to the run-in string; an output shaft; and a clutch, the clutch operable to rotationally couple the output shaft to the housing when the clutch is in a first position, rotationally couple the motor to the output shaft when the clutch is in a second position, and actuate from one of the positions to the other of the positions as a result of fluid being injected through the clutch at a flow rate which is greater than or equal to a predetermined threshold flow rate. The drill string further includes a bent sub rotationally coupled to the output shaft; and a drill bit coupled to the bent sub. The method further includes drilling in a first curved direction, due to the bent sub being at a first orientation, while injecting fluid through the drillstring at a first flow rate; injecting the fluid through the drillstring at a second flow rate, wherein the orienter will rotate the bent sub from the first orientation to a second orientation; and drilling in a second curved direction due to the bent sub being at the second orientation, while injecting fluid through the drillstring at the first flow rate.

In another embodiment, a method for forming a window in a wellbore is provided. The method includes assembling a drillstring. The drillstring includes a run-in string and an orienter. The orienter includes a motor; a housing coupled to the run-in string; an output shaft; and a clutch, the clutch operable to rotationally couple the output shaft to the housing when the clutch is in a first position, rotationally couple the motor to the output shaft when the clutch is in a second position, and actuate from one of the positions to the other of the positions as a result of fluid being injected through the clutch at a flow rate which is greater than or equal to a predetermined threshold flow rate. The drillstring further includes a cutting tool rotationally coupled to the output shaft; a whipstock; and an anchor coupled to the whipstock. The method further includes orienting the whipstock while the clutch is in the first position; and setting the anchor while the clutch is in the first position; actuating the clutch to the second position, wherein the motor rotates the cutting tool; and forming the window.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

The term "coupled" as used herein includes at least two components directly coupled together or indirectly coupled together with intervening components coupled therebetween.

Figure 1:
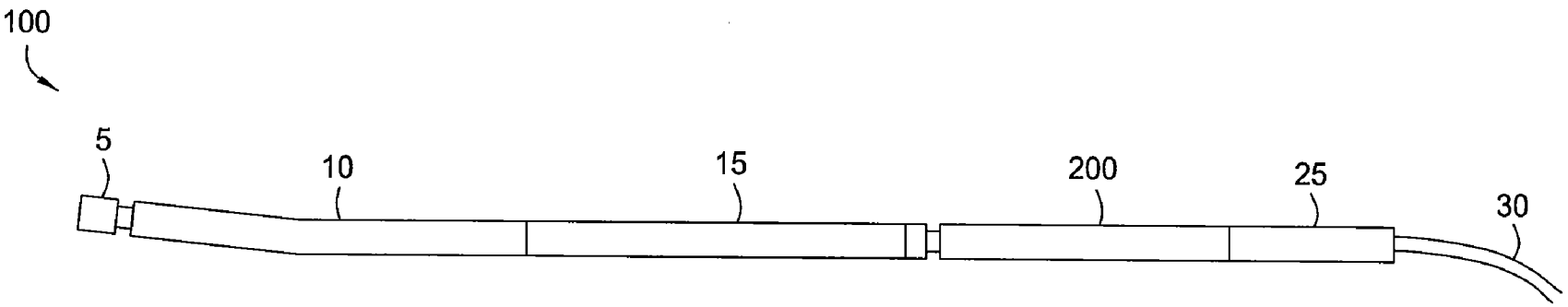
FIG. 1 is a diagram of a coiled tubing Bottom Hole Assembly (BHA), according to one embodiment of the present invention.

FIG. 1 is a diagram of a coiled tubing Bottom Hole Assembly (BHA) 100, according to one embodiment of the present invention. The coiled tubing BHA 100 includes: a drill bit 5, a bent-housing drilling motor 10, Measurement While Drilling (MWD) module 15, orienter 200, and connector 25. As discussed above, bent-housing drilling motor 10 will cause drilling in a curved direction provided that the drillstring is rotationally fixed. Alternatively, a bent sub and a straight-housing motor could be used instead of the bent-housing motor 10. The bent-housing motor 10 is a mud motor, which harnesses energy from drilling fluid by channeling it between a profiled rotor and stator, thereby imparting the energy into rotational motion of the rotor. The drill bit 5 is coupled to the rotor of the motor 10.

MWD module 15 may incorporate, for example, magnetometers and accelerometers to measure and transmit to the surface data indicative of borehole inclination and direction. The connector 25 couples the BHA 100 to a string of coiled tubing 30. The connector 25 is also coupled to the orienter 200. Discussed in more detail below, the orienter 200 contains a device which converts fluid energy into rotational energy, such as a mud motor, which is selectively rotationally coupled to the MWD module 15, the bent-housing drilling motor 10, and the drill bit 5. When rotationally coupled, the orienter 200 effects drilling in an overall straight direction (analogous to a corkscrew) and, when not, allows drilling in a curved direction.

Figure 2:
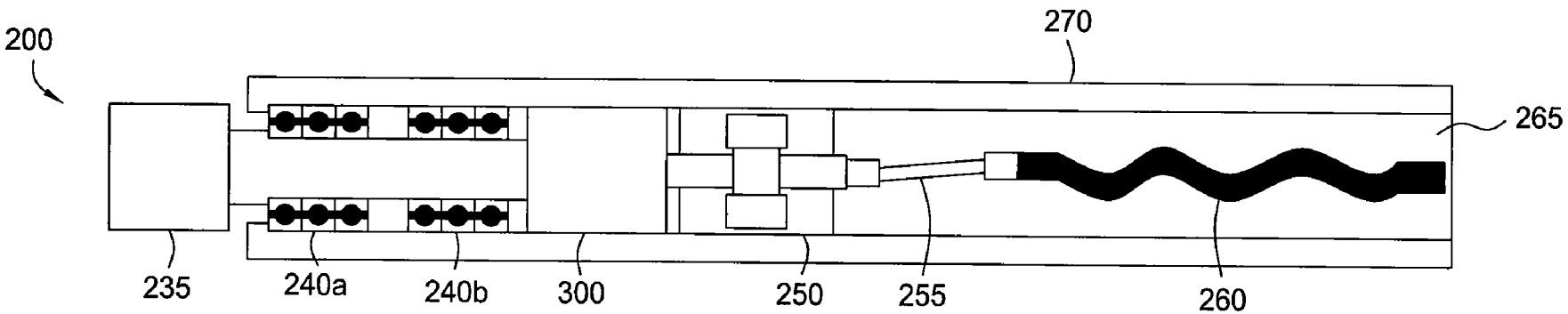
FIG. 2 is a more detailed schematic of the orienter of FIG. 1.
Figure 3A:
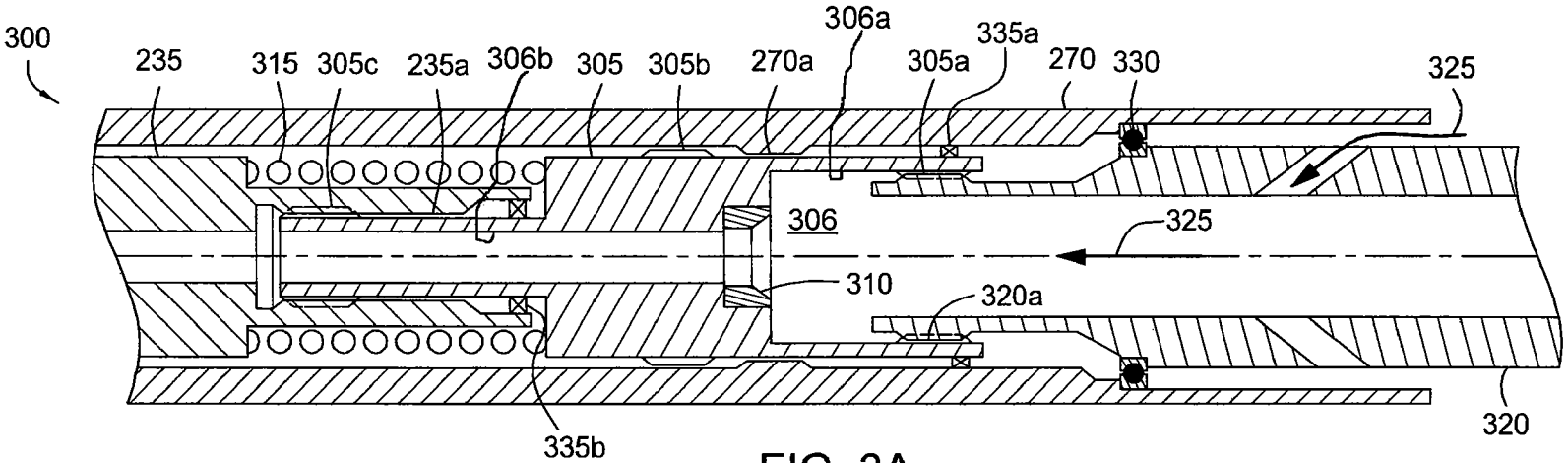
FIGS. 3A and 3B are sectional views of the clutch of FIG. 2 in an engaged and disengaged position, respectively.
Figure 3B:
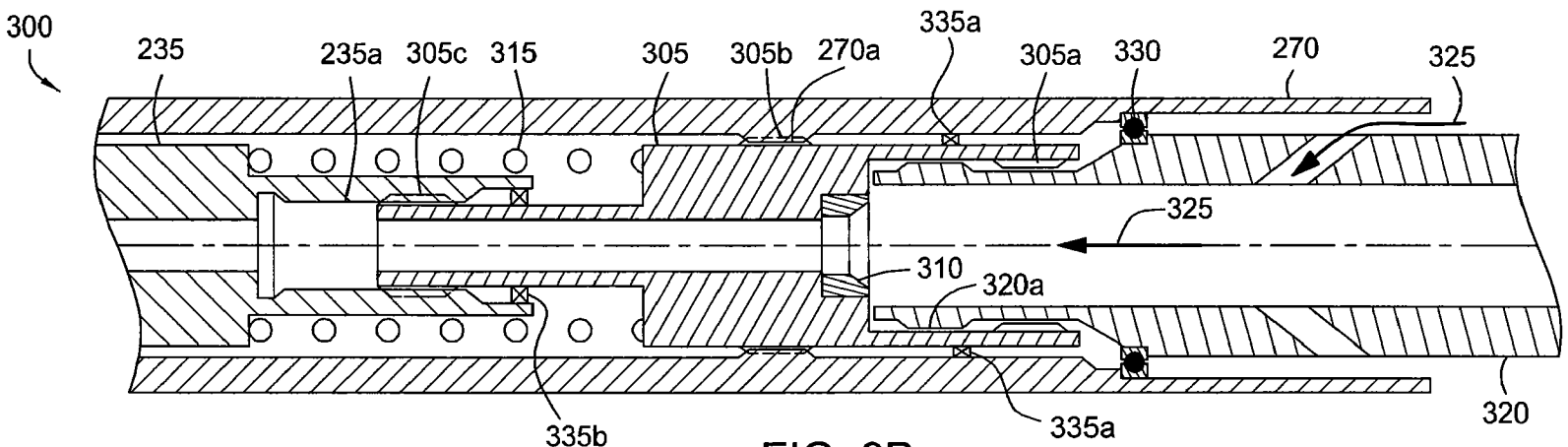

FIG. 2 is a more detailed schematic of the orienter 200 of FIG. 1. The orienter 200 includes a housing 270. Disposed in the housing 270 is stator 265. The stator 265 corresponds with a rotor 260. The rotor 260 and stator 265 transform fluid energy into mechanical energy, resulting in the rotation of the rotor. The rotor 260 is rotationally coupled through a transmission 255 and a speed reducer 250 to an input shaft 320 (see FIG. 3) of a clutch 300. The clutch 300 selectively rotationally couples the input shaft 320 to an output shaft 235. The output shaft 235 is supported for rotation relative to the housing 270 by two sets 240*a,b* of bearings FIGS. 3A and 3B are sectional views of the clutch 300 of FIG. 2 in an engaged and disengaged position, respectively. The clutch 300 has an axial flow bore therethrough. The clutch includes the input shaft 320 which has radial fluid channels therethrough (two shown). Flow of fluid through the clutch is denoted by arrows 325. The input shaft 320 is supported for rotation relative to the housing 270 by a bearing 330. The input shaft 320 is selectively rotationally coupled to a locking sleeve 305. This coupling is achieved by a splined portion 320*a* of the input shaft 320 which corresponds with a splined portion 305*a* of the locking sleeve 305, thereby rotationally coupling the two portions together when the locking sleeve 305 is moved axially into engagement with the input shaft 320.

The locking sleeve 305 is selectively rotationally coupled to the housing 270. This coupling is achieved by a second splined portion 305*b* of the locking sleeve 305 which corresponds with a splined portion 270*a* of the housing 270, thereby rotationally coupling the two portions together when the locking sleeve 305 is moved axially into engagement with the housing 270. The locking sleeve 305 is rotationally coupled to the output shaft 235 but is free to move axially relative to the output shaft. This coupling is achieved by a third splined portion 305*c* of the locking sleeve 305 which corresponds with a splined portion 235*a* of the output shaft which extends axially along a travel path of the locking sleeve 305, thereby rotationally coupling the two portions together regardless of the axial position of the locking sleeve 305 relative to the output shaft 235.

The locking sleeve 305 is axially biased away from the output shaft 235 by biasing member, such as spring 315, which is disposed between two facing shoulders of the two parts. A nozzle 310 is received in a recess formed in the locking sleeve 305 and is exposed to the fluid path 325. The nozzle 310 is disposed between a first portion 306*a* of a flow bore 306 of the locking sleeve 305 and a second portion 306*b* of the bore 306. The nozzle 310 enables the locking sleeve 305 to act as a dynamic flow piston. Flow is choked through the nozzle 310, resulting in a pressure drop across the nozzle and creating an actuation force which counters the biasing force acting on the locking sleeve 305 provided by the spring 315. In this manner, the axial position of the locking sleeve 305 may be controlled by the injection rate of fluid through the clutch 300. Optionally, a first sealing element 335*a* is disposed between the locking sleeve 305 and the housing 270 and a second sealing element 335*b* is disposed between the locking sleeve and the output shaft 235. The optional sealing elements 335*a,b* prevent excess leakage from the flow path 325.

Operation of the orienter 200 is as follows. Rotation of the orienter 200 is powered by the flow of drilling fluid provided by the surface pumps (not shown). In the engaged operating mode (FIG. 3A), the orienter 200 rotates the bent-housing motor 10 and MWD module 15 at a slow, but continuous speed, for example between about 2 and about 5 rpm, thus facilitating the "straight" drilling capability similar to that accomplished by the rotational technique employed when drilling with jointed pipe, discussed above. In this mode, the surface pumps are injecting fluid through the orienter 200 at a flow rate greater than or equal to a predetermined threshold flow rate so the actuation force from the pressure acting on the locking sleeve 305 is sufficient to compress the spring 315, thereby holding the locking sleeve 305 in a position to engage the splined portions 305*a,* 320*a.* Engagement of the splined portions means that the input shaft 325 is rotationally coupled to the locking sleeve 305 which is rotationally coupled to the output shaft 235. Alternatively, the clutch 300 could be configured so that the locking sleeve 305 is rotationally coupled to the housing 270 in the engaged position and rotationally coupled to the input shaft 320 in the disengaged position.

When it is desired to change from straight ahead drilling to oriented directional drilling, the flow rate of the surface pumps is decreased by a pre-selected amount to a flow rate that is less than the predetermined threshold flow rate, thereby decreasing the pressure acting on the locking sleeve 305. The spring 315 will then move the locking sleeve 305 out of engagement with the input shaft 320 and into a position where the splined portions 270*a,* 305*b* are engaged (FIG. 3B). The locking sleeve 305, which is rotationally coupled to the output shaft 235, is now rotationally coupled to the housing 270, which is stationary. In this mode, drilling will proceed in the direction determined by the rotational orientation of the bent-housing motor 10. It is not necessary to stop drilling ahead to change from straight-ahead directional drilling to oriented drilling. When it is desired to change from oriented drilling to straight ahead drilling, the flow rate of the pumps is increased to a flow rate which is greater than or equal to the predetermined flow rate, thereby moving the locking sleeve 305 into engagement with the input shaft 320 and rotationally coupling the input shaft 320 to the output shaft 235.

In addition to changing between straight ahead and directional drilling, the orienter 200 may be used to adjust an orientation of the directional drilling. In order to accomplish this, the clutch 300 is engaged for a relatively short time to rotate the bent sub 10 from a first orientation to a desired second orientation.

Some advantages of the orienter 200 over the prior art are as follows. No electric line is required in the coiled tubing 30 to provide power to the orienting device. This means that the system can be used with any coiled tubing drilling rig. A second difference from most prior art systems is that the orienter 200, when engaged, provides continuous rotation of the bit 5, motor 10, and MWD module 15. A third difference is that unlike some prior art systems, drilling need not stop to adjust BHA orientation. Finally, unlike any of the electrically powered systems which are very complex electro-hydraulic systems, the orienter 200 is a purely mechanical tool much less susceptible to failure in a wellbore.

Figure 4A:
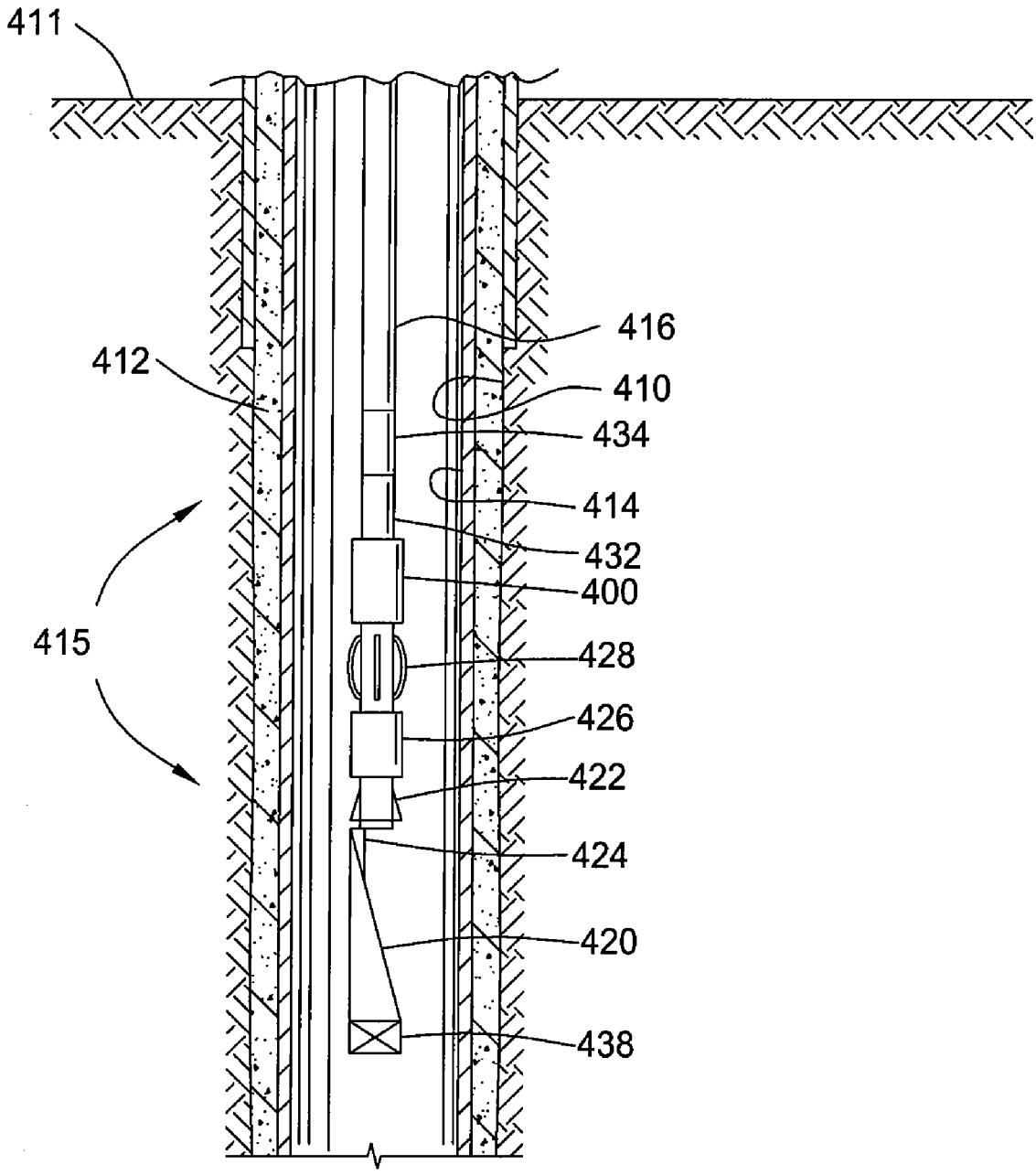
FIG. 4A is a sectional view of a drillstring run into a wellbore, according to another embodiment of the present invention.

FIG. 4A is a cross sectional view of a drillstring 415 inserted into a wellbore 410, according to another embodiment of the present invention. The wellbore 410 is drilled from a surface 411, which may be either a surface of land or sea. Typically, the wellbore 410 is cased with a casing 414. An annulus 412 between the drilled wellbore and the casing 414 is sealed with a solidifying aggregate such as concrete. The drillstring 415 includes a run-in string 416, such as coiled tubing or a string of drill pipe. Various components can be assembled as part of the drillstring 415. For example, beginning at the lower end of the arrangement, an anchor 438, such as a bridge plug, packer, or other setting device, is releasably coupled to the drillstring 415 generally on a lower end of the arrangement. Preferably, the anchor 438 is hydraulically set so that the anchor 438 can be actuated remotely and thus does not require a separate trip. The hydraulic anchor 438 may be set with a hydraulic fluid flowing through a tube (not shown). The drillstring 415 shown in FIGS. 4A-4C can be used to set the anchor 438 and the whipstock 420 and begin cutting a window 436 (see FIG. 4C) in the wellbore 410 in a single trip.

A whipstock 420 is attached to the anchor 418 and includes an elongated tapered surface that guides a cutting tool, such as a mill 422, outwardly toward casing 414. The mill 422 is releasably coupled to the whipstock 420 with a connection member 424, for example a shear pin, that may be later sheared downhole by an actuation force, such as by rotation of mill 422, by pulling on the run-in string 416, or otherwise. A spacer or watermelon mill 426 may also be coupled to the mill 422. The spacer mill 426 typically is a mill used to further define the hole or window created by the mill 422. In other embodiments, other types of cutting tools may be employed, such as hybrid bits that are capable of milling a window and continuing to drill into the formation. An exemplary hybrid bit is disclosed in U.S. Pat. No. 5,887,668 and is incorporated by reference herein.

In some arrangements, a stabilizer sub 428 is assembled as part of the drillstring 415. The stabilizer sub 428 has extensions protruding from the exterior surface to assist in concentrically retaining the drillstring 415 in the wellbore 410. A clutched mud motor 400 can be assembled with the drillstring 415 above the mills 422,426. The clutched mud motor 400 may be similar to the orienter 200 except that the rotor 260, stator 265, speed reducer 250, and transmission 255 may be replaced by a mud motor. When the clutch 300 is engaged, the mud motor 400 rotates the mills 422,426 while the drillstring 415 remains rotationally stationary (if the run-in string 416 is drill pipe, the drill pipe may be rotated in tandem with the mills 422,426 or held rotationally stationary). A position measuring member, such as an MWD tool 432, is coupled above the motor 400. The MWD tool 432 may require a certain level of flow Fm to activate and provide feedback to equipment located at the surface 411.

Figure 5:
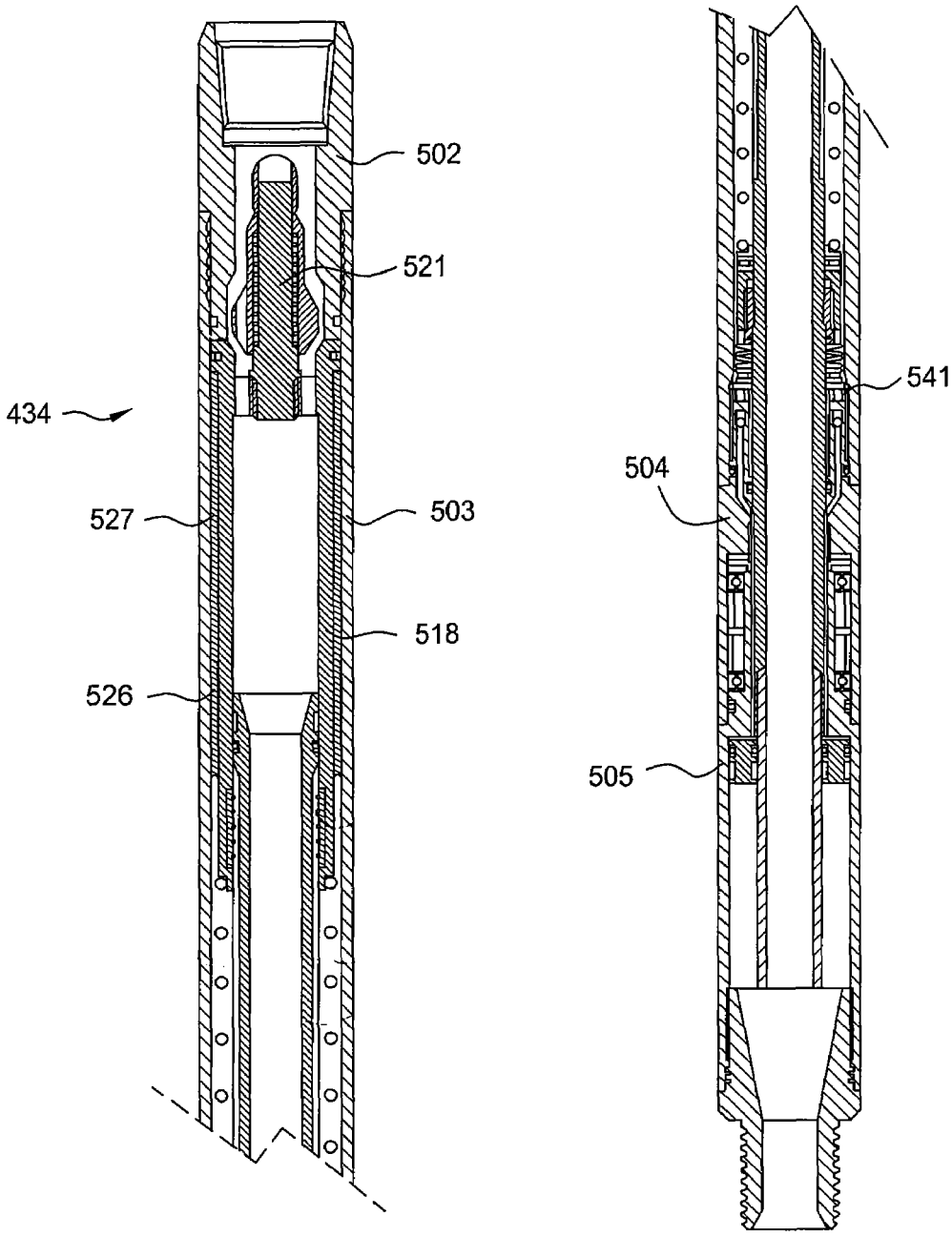
FIG. 5 (PRIOR ART)
FIG. 5 is a sectional view of the orienter of FIGS. 4A-4C.

When the run-in string 416 is coiled tubing, an orienter 434 (see also FIG. 5) is assembled as part of the drillstring 415 above the MWD tool 432. When the run-in string 416 is drill pipe, the whipstock 420 may be oriented by turning the drill pipe from the surface 411 and the orienter 434 is not needed. The orienter 434 includes housing elements 502-505 connected to one another, has a passage for, fluid such as drilling fluid, and may be activated for rotation of the whipstock 420, so that the whipstock 420 may be properly oriented. Referring to FIG. 5, the orienter 434 includes an actuator valve 521 arranged to choke the passage, so that the orienter 434 can be activated for the rotation, a piston 518 adapted for providing the rotation after the through passage has been choked, and sets of co-operating guides, preferably twisted splines 526, 527, adapted for causing the piston 518 to rotate relative to the housing 502-505. The splines 526,527 are formed in an inner surface of the housing element 503 and an outer surface of the piston 518. Thus, the orienter 434 can rotate the whipstock 420 to a desired orientation within the wellbore 410, while the MWD tool 432 provides feedback to determine the orientation. A more detailed discussion of the principles and operation of the orienter 434 may be found in U.S. Pat. No. 6,955,231, entitled "Tool for Changing the Drilling Direction while Drilling," which is hereby incorporated by reference in its entirety.

The flow rate Fo required to actuate the orienter 434 may be set above the flow rate required to activate the MWD tool 432, below the flow rate Fa required to set the anchor 438, and below the flow rate required to engage the clutch 300 of the clutched motor 400 Fc. The flow rate Fa required to set the anchor may be set below the flow rate Fc required to engage the clutch 300 of the clutched motor 400. To summarize, preferably, Fc>Fa>Fo>Fm. In the case that the run-in string 416 is drill pipe, a similar relation may be used with the exception that Fo would be omitted. In light of this relation, it may be observed that when setting the anchor, some unintended actuation of the orienter 434 may occur. To reduce this, the orienter is equipped with a choke valve 541 which controls the speed of the orienter 434. The choke valve 541 may be configured to slow the orienter sufficiently such that the unintended actuation is negligible. Further, the orienter 434 may be configured with a relatively short stroke and/or a gradual twist in the splines to further reduce the unintended actuation. Alternatively, or in addition to, the unintended actuation may be measured or estimated and the MWD tool configured with an offset to compensate for the unintended actuation. Alternatively, the offset may be manually performed at the surface.

Figures 4B, 4C:
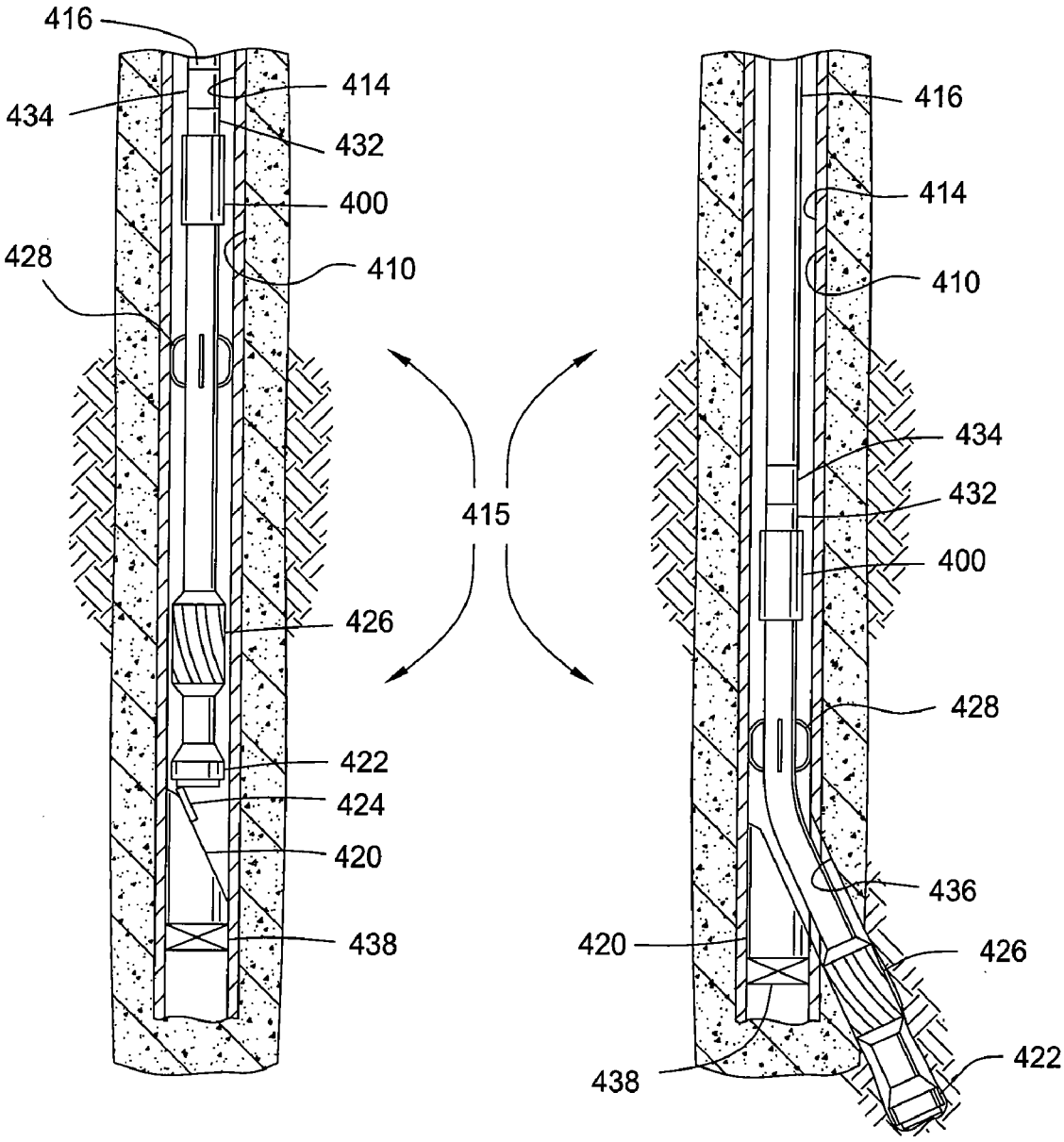
FIG. 4B is a sectional view of the drillstring of FIG. 4A with an anchor set in position.
FIG. 4C is a sectional view of the drillstring of FIG. 4A with a mill cutting an window through the casing.

FIG. 4B is a sectional view of the drillstring 415 with an anchor 438 set in position. The whipstock 420 is oriented using the orienter 434 to a desired position indicated by the MWD tool 432, while the clutch 300 allows flow through the motor 400 without engagement of the motor. The hydraulic anchor 438 is set to fix the whipstock 420 at the desired orientation.

FIG. 4C is a cross sectional view of the whipstock 420 set in position and the mill 422 cutting a window 436 through the casing 414 at an angle to the wellbore 410. In one aspect, the connection member is sheared by pulling on the run-in string 416. As the flow rate and/or pressure of fluid within the drillstring 415 increases, the clutch 300 engages the motor 400 which turns the mill 422. In another aspect, sufficient torque created by the motor 400 shears the connection member 424 between the whipstock 420 and the cutting tool 422. The mill 422 begins to turn and is guided at an angle to the wellbore 410 by the whipstock 420. As the drillstring 415 is further lowered downhole, the mill 422 cuts at an angle through the casing 414 and creates an angled window 436 therethrough. In some embodiments, the casing 414 may not be placed in a wellbore 410. It is to be understood that the arrangements described herein for cutting an angled window apply regardless of whether the casing 414 is placed in the wellbore. Actuation of the orienter 434 during this process does not affect the ability of the motor 400 to operate the mill 422 nor the direction of the mill 422 because the mill is guided by the whipstock 420.

While the foregoing is directed to embodiments of the present invention, other and further embodiments of the invention may be devised without departing from the basic scope thereof, and the scope thereof is determined by the claims that follow.

The invention claimed is:

1. A bottom hole assembly (BHA) for use in drilling a wellbore, the BHA comprising:
- a first mud motor having a stator and a rotor;
- a second mud motor having a bent stator or a stator rotationally coupled to a bent sub and a rotor;
- a drill bit rotationally coupled to the second rotor; and
- a clutch operable to:
  - rotationally couple the second stator to the first stator when the clutch is in a disengaged position,
  - rotationally couple the first rotor to the second stator when the clutch is in an engaged position, and
  - actuate from a first one of the positions to a second one of the positions as a result of fluid being injected through the clutch at a first flow rate which is greater than or equal to a predetermined threshold flow rate (PTFR), and
  - actuate from the second one of the positions to the first one of the positions at a second flow rate which is less than the PTFR, wherein the second flow rate is sufficient to operate the second motor.

2. The BHA of claim 1, further comprising a measurement while drilling (MWD) module operable to transmit data to a surface of the wellbore indicative of inclination and direction of the BHA.

3. The BHA of claim 1, wherein the clutch comprises:
- a housing rotationally coupled to the first stator and having a splined portion for mating with a second splined portion of a locking sleeve;
- an input shaft rotationally coupled to the first rotor and having a splined portion for mating with a first splined portion of the locking sleeve;
- the locking sleeve actuatable between the engaged and disengaged positions and having a third splined portion rotationally coupling the locking sleeve to a splined portion of an output shaft, and
- the output shaft rotationally coupled to the second stator.

4. The BHA of claim 3, wherein:
- the locking sleeve has a flow bore therethrough,
- the flow bore has a first portion and a second portion,
- the second portion is substantially smaller than the first portion, and
- the locking sleeve is actuatable by choking of fluid through the flow bore.

5. The BHA of claim 3, further comprising a string of coiled tubing coupled to the housing.

6. The BHA of claim 3, wherein the clutch further comprises a biasing member operable to actuate the clutch from the second position to the first position.

7. The BHA of claim 4, wherein the clutch further comprises a nozzle disposed between the portions of the locking sleeve bore.

8. The BHA of claim 1, further comprising a speed reducer disposed between the motors, the speed reducer operable to limit rotational velocity of the second stator to between about 2 and about 5 rpm.

9. The BHA of claim 1, wherein the clutch comprises:
- a housing having a splined portion for mating with a second splined portion of a locking sleeve;
- an input shaft having a splined portion for mating with a first splined portion of the locking sleeve;
- the locking sleeve:

having a flow bore therethrough, the flow bore having a first portion and a second portion, the second portion substantially smaller than the first portion, having a third splined portion rotationally coupling the locking sleeve to a splined portion of an output shaft, actuatable axially between the disengaged position and the engaged position by choking of fluid through the flow bore, the locking sleeve mating with the splined portion of the housing in the disengaged position and the splined portion of the input shaft in the engaged position;

the output shaft; and a biasing member disposed between the output shaft and the locking sleeve, the biasing member biasing the locking sleeve towards one of the axial positions.

10. The BHA of claim 1, wherein the first one of the positions is the disengaged position and the second one of the positions is the engaged position.

11. A method for drilling a wellbore using the BHA of claim 1, comprising:

drilling in a first direction while injecting fluid through a drillstring having the BHA connected at an end thereof at the first flow rate; and changing the flow rate to the second flow rate, wherein:

the first motor changes the direction of drilling to a second direction, and drilling remains continuous while changing the flow rate.

12. The method of claim 11, wherein the first direction is a substantially straight direction and the second direction is a curved direction.

13. The method of claim 11, wherein the first direction is a curved direction and the second direction is a substantially straight direction.

14. A method for drilling a wellbore using the BHA of claim 1, comprising:

drilling in a first curved direction, due to the bent sub being at a first orientation, while injecting fluid through the drillstring having the BHA connected at an end thereof at the second flow rate injecting the fluid through the drillstring at the first flow rate, wherein the first motor will rotate the bent sub from the first orientation to a second orientation; and drilling in a second curved direction due to the bent sub being at the second orientation, while injecting fluid through the drillstring at the second flow rate.

15. A method for forming a window in a wellbore, comprising:

connecting a bottom hole assembly (BHA) to an end of a coiled tubing drill string, the BHA comprising:

a mud motor having a stator and a rotor, the stator rotationally coupled to the drill string;

a cutting tool;

a clutch operable to:

rotationally couple the cutting tool to the stator when the clutch is in a first position, rotationally couple the rotor to the cutting tool when the clutch is in a second position, and actuate from one of the positions to the other of the positions as a result of fluid being injected through the clutch at a flow rate which is greater than or equal to a predetermined threshold flow rate (PTFR);

a whipstock;

an anchor coupled to the whipstock; and an orienter disposed between the stator and the drill string and comprising:

a housing rotationally coupled to the drill string and having a guide, and a piston rotationally coupled to the stator, disposed in the housing, and having a guide, wherein the guides cooperate to cause continuous rotation of the piston relative to the housing when the piston is operated by sufficient fluid flow through the housing;

orienting the whipstock while the clutch is in the first position by operating the orienter;

setting the anchor while the clutch is in the first position;

actuating the clutch to the second position, wherein the motor rotates the cutting tool; and forming the window.

16. The method of claim 15, wherein:

the clutch is in the first position at a flow rate less than the PTFR, and the clutch is actuated to the second position by injecting drilling fluid through the drill string at a flow rate greater than or equal to the PTFR.

17. The method of claim 16, wherein the anchor is set by injecting drilling fluid through the drill string at a flow rate Fa less than the PTFR.

18. The method of claim 17, wherein:

the BHA further comprises a measurement while drilling (MWD) module, the MWD module is operable by injecting drilling fluid through the drill string at a flow rate Fm less than the PTFR and less than the Fa, and the whipstock is oriented while injecting drilling fluid at a flow rate between Fm and Fa.

19. The method of claim 18, wherein:

the orienter is operable by injecting drilling fluid through the drill string at a flow rate Fo greater than the Fm and less than the Fa and the PTFR, and the whipstock is oriented by injecting drilling fluid through the drill string at a flow rate between Fo and Fa.

20. The method of claim 19, wherein the guides are twisted splines.

21. The method of claim 15, wherein the whipstock is releasably coupled to the cutting tool and the whipstock is released by rotating the cutting tool.

* * * * *